US008365329B1

(12) United States Patent
Barsosky

(10) Patent No.: US 8,365,329 B1
(45) Date of Patent: Feb. 5, 2013

(54) INFANT FEEDING AND SUPPORT PILLOW

(76) Inventor: Michelle Barsosky, Amherst, NH (US)

( * ) Notice: Subject to any disclaimer, the term of this patent is extended or adjusted under 35 U.S.C. 154(b) by 0 days.

(21) Appl. No.: 13/526,740

(22) Filed: Jun. 19, 2012

Related U.S. Application Data

(60) Provisional application No. 61/527,743, filed on Aug. 26, 2011.

(51) Int. Cl.
*A47G 9/10* (2006.01)

(52) U.S. Cl. ..... 5/655; 5/632; 5/657

(58) Field of Classification Search ..... 5/632, 630, 5/655, 640, 657
See application file for complete search history.

(56) References Cited

U.S. PATENT DOCUMENTS

| | | | | |
|---|---|---|---|---|
| 5,095,567 | A | 3/1992 | Kenoyer | |
| 5,261,134 | A | 11/1993 | Matthews | |
| 5,661,861 | A | 9/1997 | Matthews | |
| D399,675 | S * | 10/1998 | Ferris | D6/601 |
| 6,233,767 | B1 | 5/2001 | Horowitz | |
| 6,279,185 | B1 | 8/2001 | Matthews | |
| 6,412,128 | B1 | 7/2002 | Matthews | |
| 6,434,770 | B2 | 8/2002 | Matthews Brown | |
| 6,453,493 | B1 | 9/2002 | Matthews Brown | |
| 6,532,612 | B2 | 3/2003 | Matthews Brown | |
| 6,625,828 | B2 | 9/2003 | Matthews Brown | |
| 6,640,977 | B2 | 11/2003 | Matthews Brown et al. | |
| 6,671,908 | B2 | 1/2004 | Brown et al. | |
| 6,685,024 | B1 | 2/2004 | Matthews | |
| 6,763,539 | B1 | 7/2004 | Bartley et al. | |
| 6,810,545 | B1 | 11/2004 | Darling et al. | |
| 6,851,143 | B2 | 2/2005 | Matthews Brown | |
| 6,857,150 | B2 | 2/2005 | Matthews Brown et al. | |
| 6,892,406 | B2 | 5/2005 | Littlehorn | |
| 6,944,898 | B2 | 9/2005 | Matthews Brown et al. | |
| 7,000,274 | B2 | 2/2006 | Matthews Brown et al. | |
| 7,000,275 | B2 | 2/2006 | Matthews Brown et al. | |
| 7,000,766 | B2 | 2/2006 | Matthews Brown et al. | |
| 7,017,212 | B2 | 3/2006 | Matthews Brown | |
| 7,055,196 | B2 | 6/2006 | Littlehorn | |
| 7,089,639 | B2 | 8/2006 | Matthews Brown et al. | |
| 7,127,760 | B2 | 10/2006 | Bartley et al. | |
| 7,146,663 | B2 | 12/2006 | Brown et al. | |
| 7,290,303 | B2 | 11/2007 | Mead et al. | |
| 7,331,073 | B2 | 2/2008 | Littlehorn et al. | |
| 7,353,551 | B2 | 4/2008 | Racovolis | |
| 7,376,993 | B2 | 5/2008 | Myers et al. | |
| 7,404,222 | B2 | 7/2008 | Tidwell | |
| 7,430,765 | B2 | 10/2008 | Brown | |
| 7,430,774 | B2 | 10/2008 | Littlehorn et al. | |

(Continued)

OTHER PUBLICATIONS

My Brest Friend Twin nursing pillow, http://www.amazon.com/My-Brest-Friend-Deluxe-Nursing/dp/B0032Z81M4.

(Continued)

*Primary Examiner* — Fredrick Conley
(74) *Attorney, Agent, or Firm* — Mesmer & Deleault, PLLC

(57) ABSTRACT

An infant feeding and support pillow has a pillow cover and filling material disposed within the pillow cover. The pillow cover has a longitudinal base portion with a first end region, a middle region, and a second end region. A first end arm with a distal end extends transversely from the first end region of the longitudinal base portion. At least one middle arm with a distal end extends transversely from the middle region of the longitudinal base portion. A second end arm with a distal end extends transversely from the second end region of the longitudinal base portion. The first end arm, the longitudinal base portion, and the middle arm define a first opening configured to hold a first infant. The middle arm, the longitudinal base portion, and the second end arm define a second opening configured to hold a second infant.

20 Claims, 9 Drawing Sheets

U.S. PATENT DOCUMENTS

| | | | | |
|---|---|---|---|---|
| 7,454,808 | B2 | 11/2008 | Parilla | |
| 7,472,443 | B2 | 1/2009 | Littlehorn et al. | |
| 7,562,406 | B1 * | 7/2009 | Leach | 5/655 |
| 7,587,773 | B2 | 9/2009 | Littlehorn et al. | |
| 7,624,461 | B2 | 12/2009 | Tidwell et al. | |

OTHER PUBLICATIONS

EZ-2-Nurse Nursing Pillow, http://www.justmultiples.com/nursing-pillow-twin-san-diego.html.
Boppy website, http://www.boppy.com/catalog/.
Mum E pillow, http://www.maternitypillow.co.uk/Mum-quotEquot-Pillow-Its-Unique-Shape-Provides-Full-Support-amp-Super-Comfort__p__127.html.
Etsy website, http://ny-image2.etsy.com/il__fullxfull,95507082.jpg.
My Brest Friend Twin nursing pillow, http://www.amazon.com/My-Brest-Friend-Deluxe-Nursing/dp/B0032Z81M4 (last visited Jun. 8, 2012).
EZ-2-Nurse Nursing Pillow, http://www.justmultiples.com/nursing-pillow-twin-san-diego.html (last visited Jun. 8, 2012).
Boppy website, http://www.boppy.com/catalog/ (last visited Jun. 8, 2012).
Mum E pillow, http://www.maternitypillow.co.uk/Mum-guotEquot-Pillow-Its-Unique-Shape-Provides-Full-Support-amp-Super-Comfort__p__127.html (last visited Jun. 8, 2012).
Etsy website, http://ny-image2.etsy.com/il__fullxfull,95507082.jpg (last visited Jun. 8, 2012).

* cited by examiner

INFANT FEEDING AND SUPPORT PILLOW

This application claims the benefit of U.S. provisional patent application Ser. No. 61/527,743, filed Aug. 26, 2011.

BACKGROUND OF THE INVENTION

1. Field of the Invention

The present invention relates generally to pillows and specifically to an infant feeding and support pillow.

2. Description of the Prior Art

For centuries, traditional pillows have been used to provide comfort and support for users while sleeping or relaxing. Traditional pillows include a fabric liner filled with a cushioning material such as, for example, goose down, feathers, foam, etc. Traditional pillows are typically configured to be rectangular or circular in shape. These traditional basic shapes may be used for a wide variety of applications. Certain traditional pillows, however, have alternative shapes that are customized for more specific applications. For example, curved neck pillows provide support for airline travelers and lumbar support pillows reduce back pain for vehicle drivers.

One pillow designed specifically for use with infants is an infant feeding and support pillow such as the Boppy® pillow produced by Boppy International. The Boppy® infant feeding and support pillow has a C-shape. In one use, an infant may be placed in an open central region while being surrounded by cushioning. This cushioning protects the infant from falling over onto a hard surface and gently restrains the infant from crawling away into unsafe areas. In another use, the Boppy® pillow may be placed around the waist of a mother (with the opening positioned towards the mother's back) to provide a cushioned surface to support the mother's arms while feeding the infant.

SUMMARY OF THE INVENTION

Unfortunately, deficiencies exist with the above-described pillows. For example, traditional infant feeding and support pillows are only configured to hold one child. Parents with twins would need a second pillow to accommodate a second child. Parents of small children know that one of the most significant challenges they face is transporting that child with all of the child's equipment (e.g., formula, toys, diapers, etc.). For parents with twins, this challenge is magnified. Given the challenge of carrying a large amount of equipment for twins, having to carry two infant feeding and support pillows becomes impractical.

Additionally, using two infant feeding and support pillows for a set of twins forces the infants to be positioned far enough away from each other that the twins cannot play with each other (this is true even if the pillows are place directly next to each other). Being able to see one's sibling without being able to reach him/her may be distressing for an infant twin.

Another deficiency with the above-described pillows is that traditional infant feeding and support pillows lack the support needed for a mother to hold and feed two infants at one time. Nursing twins at the same time can put a lot of strain on a mother's arms and back. Also, infant feeding and support pillows such as the Boppy® pillow do not provide adequate support for a mother's back. As a result, a mother is faced with the time-consuming task of feeding two infants individually rather than at one time.

In contrast to the above-described traditional pillows, the present invention provides an improved infant feeding and support pillow that includes at least two openings capable of holding infants close enough to play with each other, is adjustable to allow a mother to nurse the infants, and supports both of the mother's arms and the mother's back during nursing.

One embodiment of the present invention is directed to an infant feeding and support pillow that has a pillow cover with filling material disposed within the pillow cover. The cover has a longitudinal base portion with a first end region, a middle region, and a second end region. A first end arm having a distal end extends transversely from the first end region of the longitudinal base portion. At least one middle arm with a distal end extends transversely from the middle region of the longitudinal base portion. The middle arm(s) extends in substantially the same direction as the first end arm. A second end arm having a distal end extends transversely from the second end region of the longitudinal base portion. The second end arm extends in substantially the same direction as the first end arm. The first end arm, the longitudinal base portion, and the at least one middle arm define a first opening configured to hold a first infant. The second end arm, the longitudinal base portion, and the at least one middle arm define a second opening configured to hold a second infant. In some embodiments, the openings are substantially circular, but other opening shapes may also be used, such as rectangular, triangular, or other shapes.

In another embodiment of the present invention, the distal end of the first end arm curves towards the distal end of the at least one middle arm and the distal end of the second end arm curves toward the distal end of the at least one middle arm.

In another embodiment of the present invention, the distal end of the at least one middle arm has two opposing protruding portions thereby substantially defining a T-shape.

In another embodiment of the present invention, the filling material is open-cell foam, closed-cell foam, memory foam, latex rubber foam, polyester fiberfill, polystyrene beads, cotton, wool, feathers, or a combination of these materials.

In another embodiment of the present invention, the pillow has an adjustable strap extending between the distal end of the first end arm and the distal end of the second end arm. In one embodiment, the strap includes a fastening device. The fastening device may be a spring buckle, a clip, at least one D-ring, a snap, a button, a hook-and-loop fastener, a hook, or combination of these devices.

In another embodiment of the present invention, the pillow cover is removable.

In another embodiment of the present invention, the pillow cover is reversible.

In another embodiment of the present invention, the pillow cover is substantially E-shaped.

In another embodiment of the present invention, the pillow cover also has a first lobe and a second lobe each extending along a back edge of the longitudinal base portion. The middle region of the longitudinal base portion, the first lobe, and the second lobe define a third opening opposite the at least one middle arm. Centers of the first opening, the second opening, and the third opening define a triangle.

In another embodiment of the present invention where the pillow has a third opening in a triangular configuration, the pillow has a removable insert configured and arranged to occupy the third opening. In one embodiment, the removable insert extends above the top surface of the longitudinal base portion. In another embodiment, an optional strap connects between the first lobe and the second lobe.

In another embodiment of the present invention, the pillow includes a first middle arm and a second middle arm where the longitudinal base portion define a third opening positioned between the first opening and the second opening, the third opening configured to hold a third infant. The third opening is substantially circular in some embodiments.

DETAILED DESCRIPTION OF THE PREFERRED EMBODIMENT

Figure 1:
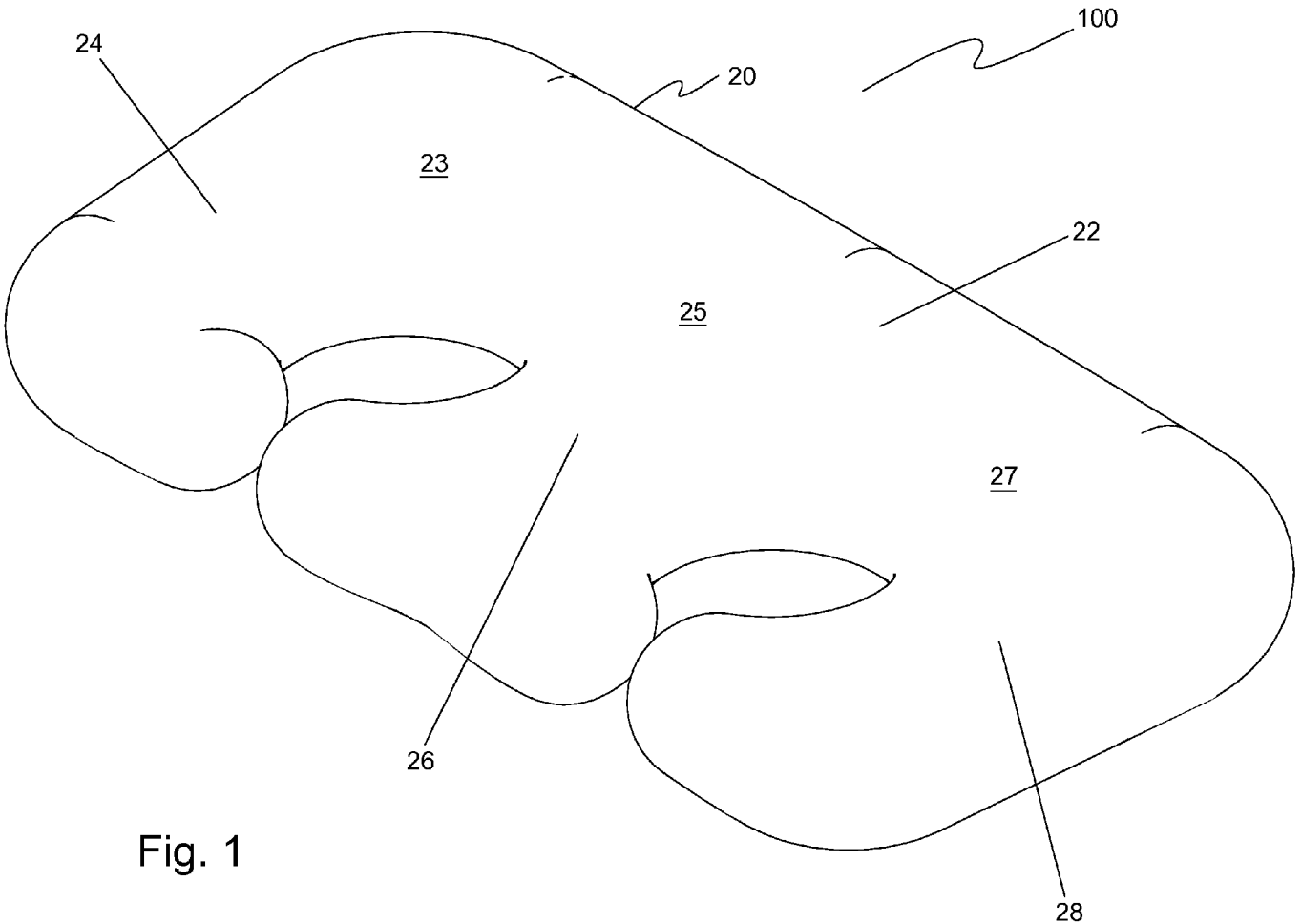
FIG. 1 illustrates a perspective view of one embodiment of an infant feeding and support pillow.

The preferred embodiments of the present invention are illustrated in FIGS. 1-9. FIG. 1 illustrates an E-shaped infant feeding and support pillow 100 with pillow cover 20 and filling material 80 (not shown) disposed within cover 20. Pillow cover 20 has a longitudinal base portion 22, a first end arm 24, a middle arm 26, and a second end arm 28. First end arm 24 extends transversely from a first end region 23 of longitudinal base portion 22. Middle arm 26 extends transversely from a middle region 25 of longitudinal base portion 22. Second end arm 28 extends transversely from a second end region 27 of longitudinal base portion 22 to form an E-shaped structure. As viewed from above, infant feeding and support pillow 100 preferably has an overall shape of a rectangle with rounded corners, but other shapes are acceptable, such as an oval, a rectangle without rounded corners, a trapezoid, kidney-shape, and the like.

Examples of filling material 80 include open-cell foam, closed-cell foam, natural latex rubber foam, memory foam, polyester fiberfill (e.g., micro denier fiber fill), cotton, beads (e.g., polystyrene beads), beans, cotton, wool, feathers, and the like. In one embodiment, pillow filling material 80 is removable from pillow cover 20 for ease of washing pillow cover 20. In another embodiment, pillow cover 20 is reversible.

Figure 2:
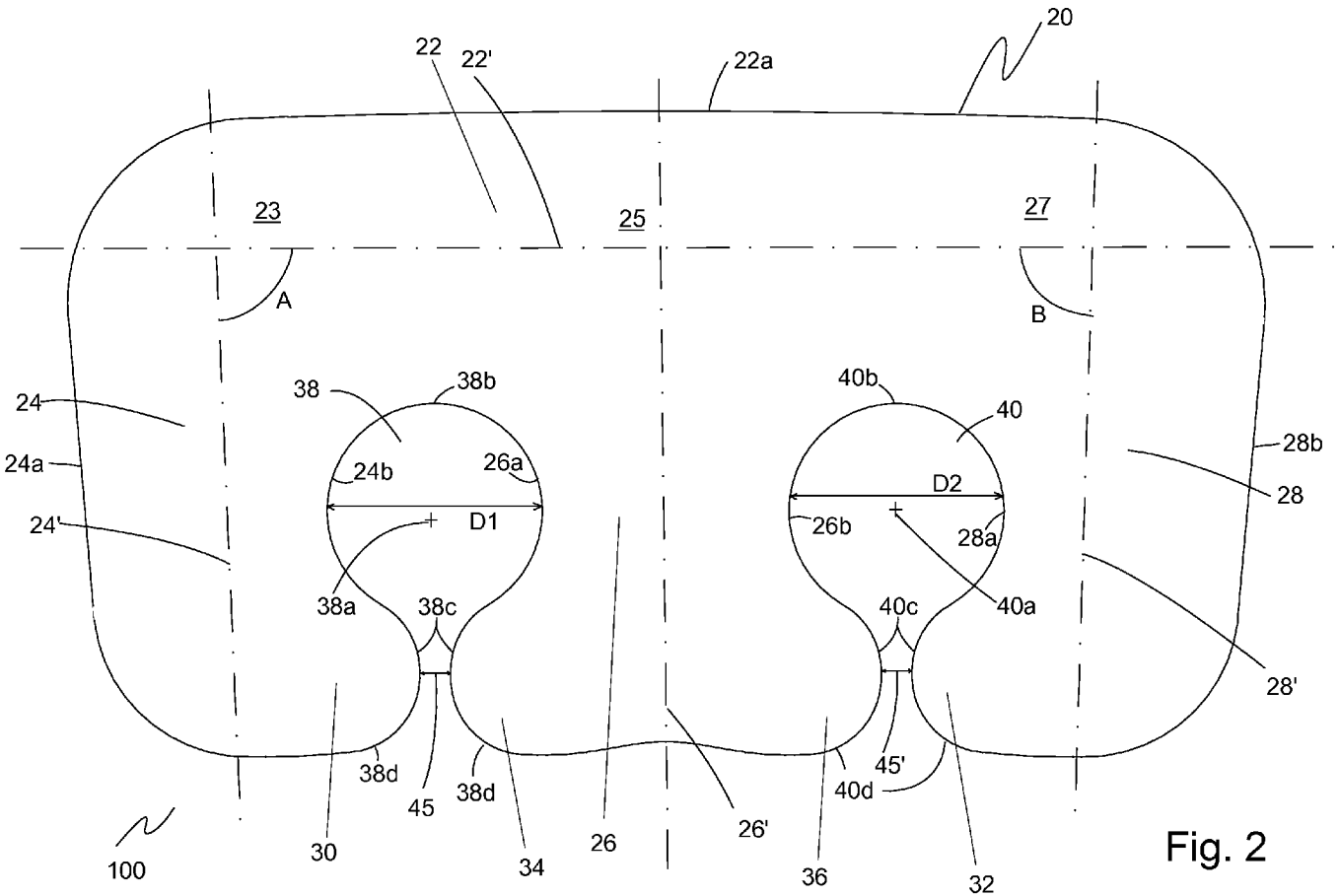
FIG. 2 illustrates a top view the infant feeding and support pillow of FIG. 1.

Now turning to FIG. 2, there is illustrated a top view of the embodiment of infant feeding and support pillow of FIG. 1. First end arm 24 extends along a longitudinal first-end-arm axis 24', middle arm 26 extends along a longitudinal middle arm axis 26', and second end arm extends along a longitudinal second-end-arm axis 28'. Longitudinal base portion 22 extends along a longitudinal base axis 22'. Axes 24', 26', 28' of first end arm 24, middle arm 26, and second end arm 28, respectively, extend transversely from longitudinal base portion 22 in the same general direction. Axes 24', 26', 28' are preferably parallel or approximately parallel to each other so infant support and feeding pillow 100 has an E-shape. Any of axes 24', 26', 28', however, may cross longitudinal base axis 22' through longitudinal base portion 22 at an angle greater than, equal to, or less than ninety degrees. In one embodiment, for example, axis 26' of middle arm 26 is perpendicular to longitudinal base axis 22', axis 24' of first end arm 24 crosses axis 22' at an angle A that is acute, and axis 28' of second end arm 28 crosses axis 22' at an angle B that is acute. Thus, first end arm 24 and second end arm 28 each extend towards middle arm 26.

First end arm 24 has a distal end 30 that is opposite of first end region 23 of longitudinal base portion 22. First end arm has first outside edge 24*a* and first inside edge 24*b*. Middle arm 26 includes two distal ends 34, 36 that are opposite of middle region 25 of longitudinal base portion 22. Middle arm 26 has first middle inside edge 26*a* and second middle inside edge 26*b*. Second end arm 28 has a distal end 32 that is opposite of second end region 27 of longitudinal base portion 22. Second end arm has second arm inside edge 28*a* and second arm outside edge 28*b*. First inside edge 24*b* is laterally separated from first middle inside edge 26*b* by distance D1 to define a first opening 38 therebetween. Distance D1 in some embodiments is a constant value; in other embodiments, D1 increases and/or decreases from a first opening base margin 38*b* nearest longitudinal base portion 22, through an optional neck portion 38*c* of first opening 38, and to a first opening front edge margin 38*d*. For a comfortable shape of infant support and feeding pillow 100, first outside edge 24*a* of first end arm 24 is preferably not, but may be, parallel to first inside edge 24*b*.

Second middle inside edge 26*b* is laterally separated from second arm inside edge 28*a* by distance D2 to define a second opening 40 therebetween. Similar to D1, D2 may have a constant value or may increase and/or decrease from a second opening base margin 40*b*, through an optional second opening neck portion 40*c* of second opening 40, and to a second opening front edge margin 40*d*. Second inside edge 28*a* is preferably not, but may be, parallel to second outside edge 28*b*.

Distal ends 34, 36 of middle arm 26 extend from middle arm 26 to define a T-shape. In some embodiments, first distal end 34 and distal end 30 of first end arm 24 curve towards each other to further define first opening 38 to support an infant. First distal end 34 of middle arm 26 and distal end 30 of first end arm 24 may extend to contact each other, or may be separated by a gap 45. First arm inside edge 24*b* of first end arm 24, first middle inside edge 26*a* of middle arm 26, and first opening base margin 38*b* along longitudinal base portion 22 are preferably curved to give opening 38 a substantially circular shape. Distal ends 34, 30 of middle arm 26 and first end arm 24, respectively, may be releasably held together with a snap, hook-and-loop fastener, or other device attached to distal ends 34, 30.

Similarly, second distal end 36 of middle arm 26 and distal end 32 of second end arm 28 each curve towards each other to define a second opening 40 to support a second infant. Second distal end 36 and distal end 32 of second end arm 28 may extend to contact each other, or may be separated by a gap 45'. Second arm inside edge 28*a* of second end arm 28, second middle inside edge 26*b* of middle arm 26, and second opening base margin 40*b* along longitudinal base portion 22 are preferably curved to give second opening 40 a substantially circular shape. The shape of either or both of first opening 38 and second opening 40 is preferably circular, but due to the generally soft nature of infant feeding and support pillow 100, other shapes are acceptable, such as rectangular, star-shaped, triangular, irregular, and others. Distal ends 36, 32 of middle arm 26 and second end arm 28, respectively, may be releasably held together with a snap, hook-and-loop fastener, or other device attached to distal ends 36, 32.

Figure 3:
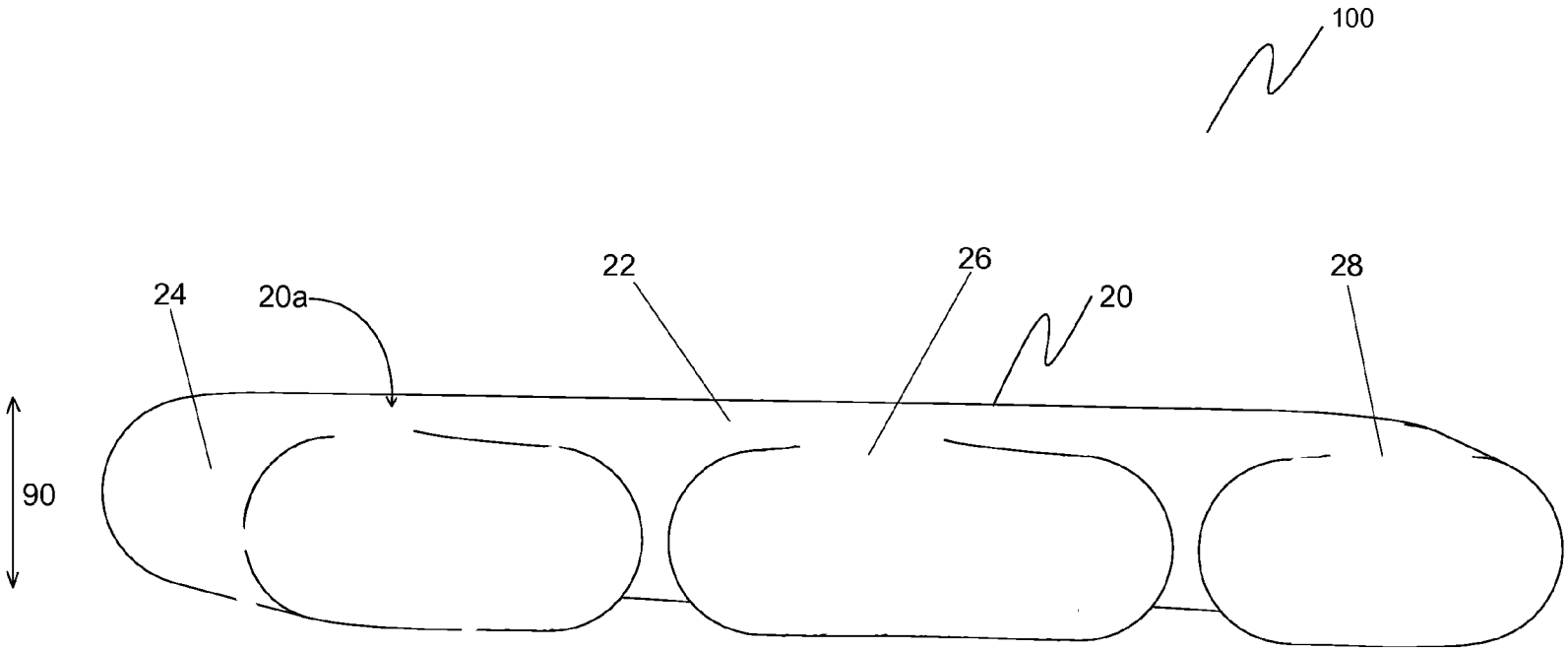
FIG. 3 illustrates a front view of the infant feeding and support pillow of FIG. 1

FIG. 3 illustrates a front perspective view of infant feeding and support pillow 100 of FIG. 1. Infant feeding and support pillow 100 has a top surface 20*a* and thickness, which is represented by arrow 90. Each of the longitudinal base portion 22, first end arm 24, middle arm 26, and second end arm 28 preferably has a cross-sectional shape that is oval or circular. Other cross-sectional shapes are also acceptable, including rectangular, trapezoidal, and the like.

Figure 4:
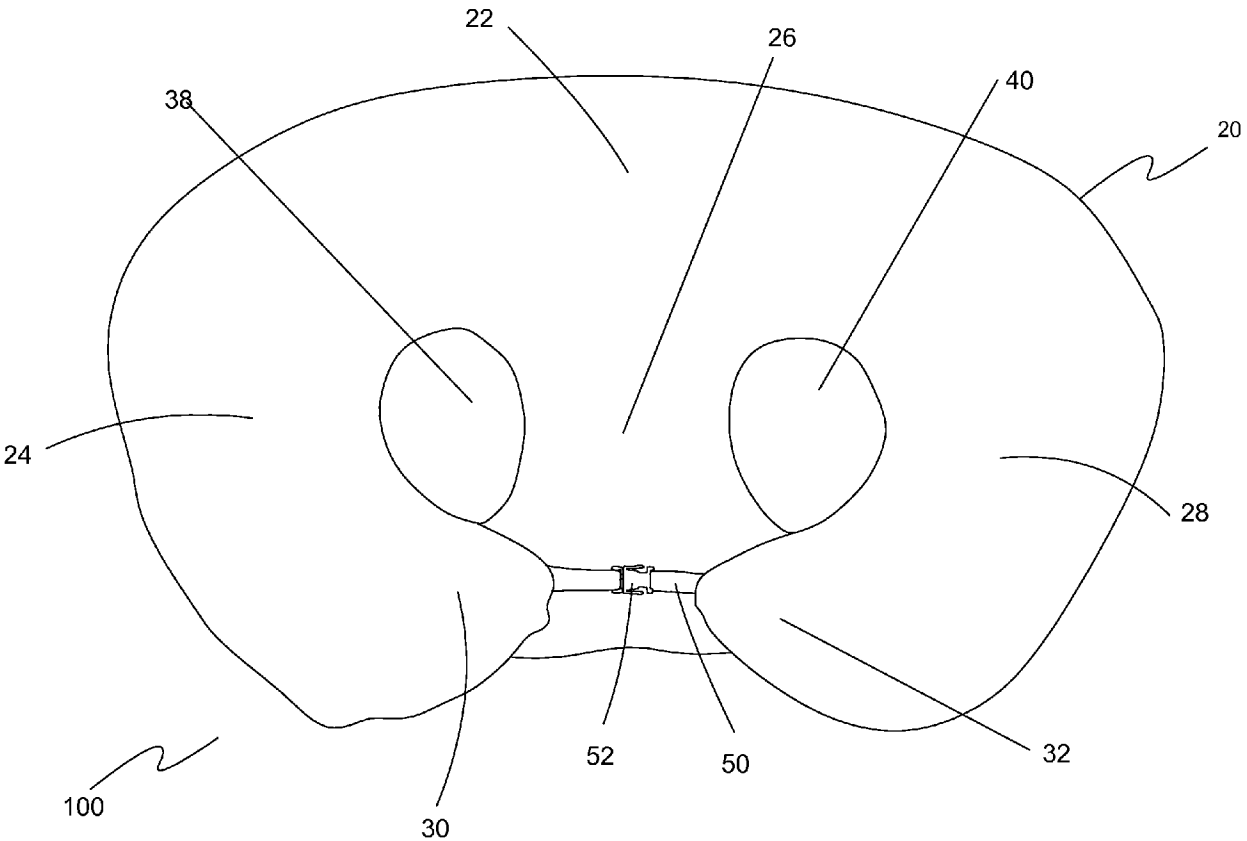
FIG. 4 illustrates a top view of an embodiment of the infant feeding and support pillow of FIG. 1 showing an optional strap and connecting device.

In some embodiments as shown in FIG. 4, infant feeding and support pillow 100 includes a strap 50 and fastening device 52. Strap 50 connects between distal ends 30, 32 of first end arm 24 and second end arm 28, respectively, to draw distal ends 30, 32 together. By moving distal ends 30, 32 together, the size of openings 38, 40 may optionally be made smaller to support very small babies such as premature babies. Strap 50 and fastening device 52 allow the user to connect distal ends 30, 32 while nursing. Strap 50 is adjustable to accommodate women of different sizes. Connector 52 is preferably a spring buckle, but may be any suitable fastening device, including a clip, one or more D-ring(s), a snap, a button, a hook-and-loop fastener such as the hook-and-loop fastener sold under the trademark Velcro®, a hook, or combination of these devices.

Figure 5:
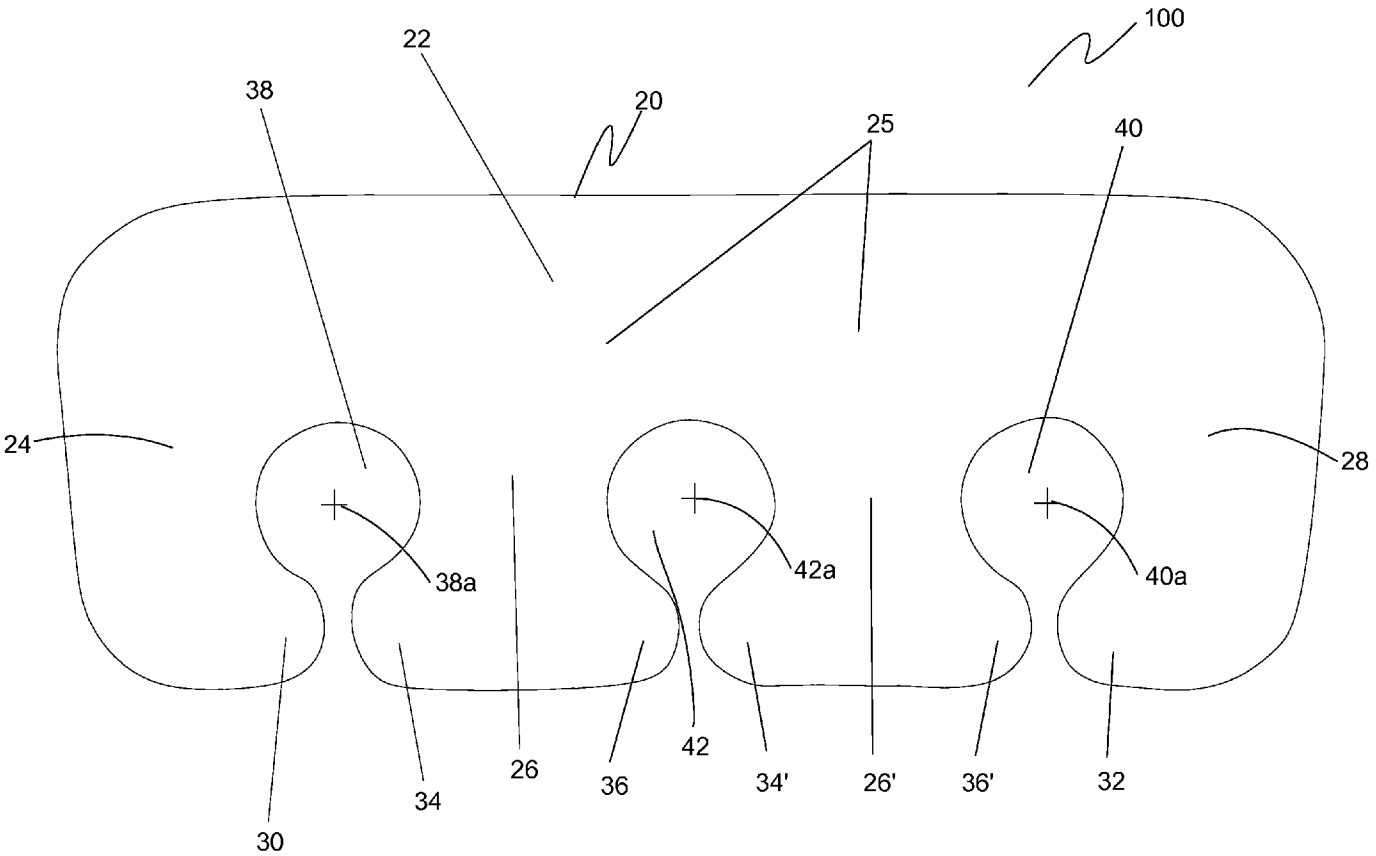
FIG. 5 illustrates a top view of another embodiment of an infant feeding and support pillow showing a third opening between the first opening and the second opening.

In another embodiment shown in FIG. 5, pillow cover 20 of infant feeding and support pillow 100 has a first middle arm 26 and a second middle arm 26' extending from middle region 25 of longitudinal base portion 22, defining a third opening 42. In this embodiment, infant feeding and support pillow 100 has three openings 38, 40, 42. Second middle arm 26' has first additional middle inside edge 26*a*' and second additional middle inside edge 26*b*'. Second inside edge 26*b* of first middle arm 26 is laterally separated from first additional middle inside edge 26*a*' of second middle arm 26' by distance D3 to define a third opening 42 therebetween. Distance D3 in some embodiments has a constant value, but D3 may increase and/or decrease from a third opening base margin 42*b* nearest longitudinal base portion 22, through an optional third opening neck portion 42*c*, to a third opening front edge margin 42*d*.

First middle arm 26 has distal ends 34, 36 and second middle arm 26' has distal ends 34', 36'. First distal end 34 of first middle arm 26 and distal end 30 of first end arm 24 preferably curve towards each other to give first opening 38 a substantially circular shape. Second distal end 36' of second middle arm 26' and distal end 32 of second end arm 28 each preferably curve towards each other to give second opening 40 a substantially circular shape. First distal end 34' of second middle arm and second distal end 36 of first middle arm 26 preferably curve towards each other to give third opening 42 a substantially circular shape. Alternately or in addition, second middle inside edge 26*b* of first middle arm 26, first additional middle inside edge 26*a*' of second middle arm 26', and third opening base margin 42*b* along longitudinal base portion 22 are preferably curved to give third opening a substantially circular shape.

Centers 38*a*, 40*a*, 42*a* of openings 38, 40, 42, respectively, are positioned in a substantially linear arrangement to support three infants. Third opening 42 is sized to support an infant or to fit around a mother's waist. Preferably, third opening 42 is adjustable in size to accommodate either an infant or an adult. Opening 38 is separated from third (middle) opening 42 by first middle arm 26 and third opening 42 is separated from opening 40 by second middle arm 26'. As noted above, the shapes of first opening 38, second opening 40, and third opening 42 are preferably circular, but may also be rectangular, star-shaped, triangular, irregular, or other shapes.

Figure 6:
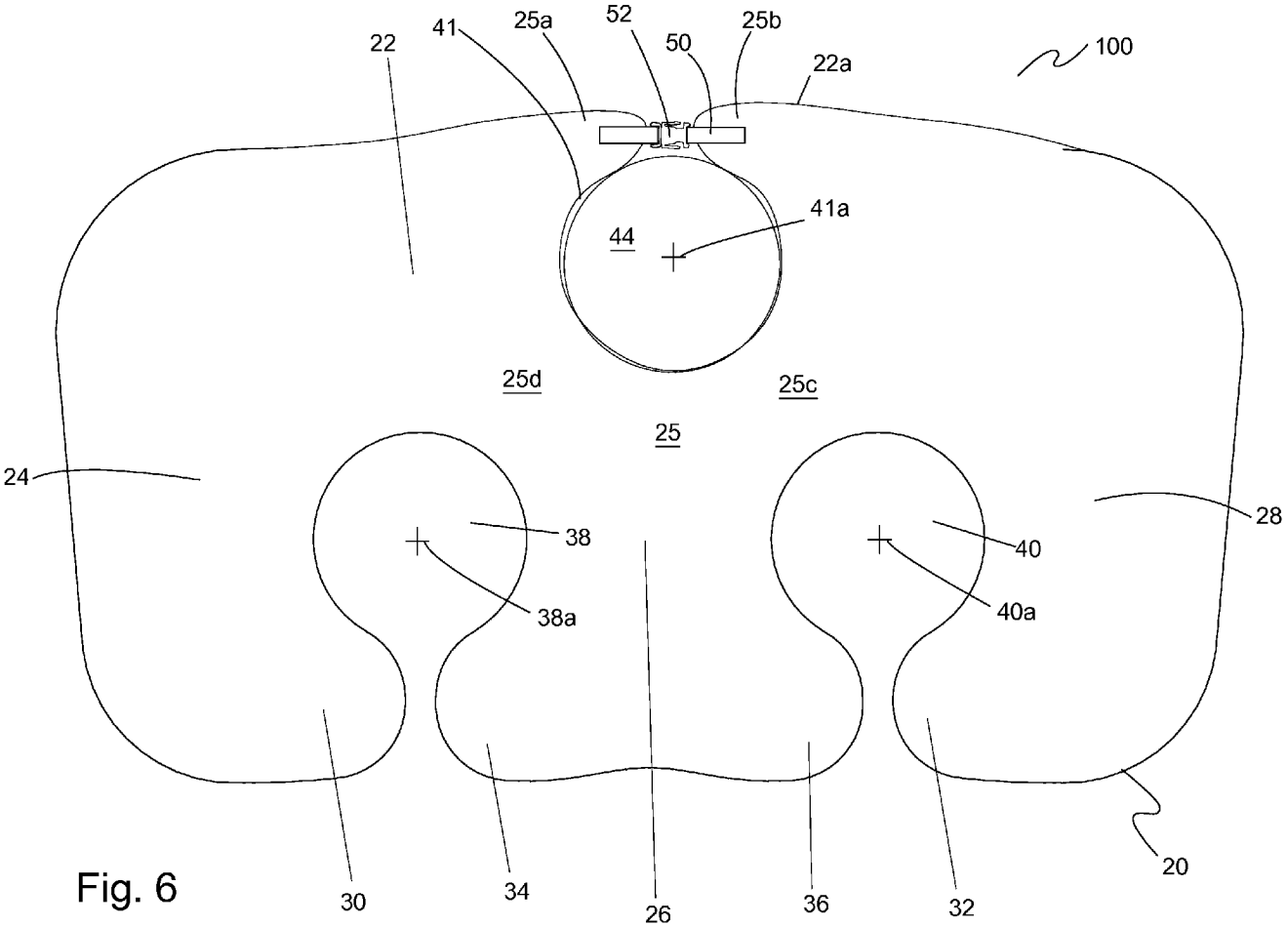
FIG. 6 illustrates a top view of another embodiment of the infant feeding and support pillow showing a third opening that forms a triangle with the first opening and the second opening.

FIG. 6 illustrates yet another embodiment of infant feeding and support pillow 100. In this embodiment, middle region 25 of longitudinal base portion 22 of pillow cover 20 has a first lobe 25*a* and a second lobe 25*b* along a back edge 22*a* of longitudinal base portion 22. Lobes 25*a*, 25*b* and middle region 25 define an alternate third opening 41 in longitudinal base portion 22. Alternate third opening 41 has center 41*a*. Alternate third opening 41 is preferably substantially circular, but may have other shapes as noted above for first opening 38 and second opening 40. Lobes 25*a*, 25*b* extend towards each other along back edge 22*a* and close third opening 41 when drawn together. Centers 38*a*, 40*a*, 41*a* of openings 38, 40, 41, respectively, define a triangle.

Alternate third opening 41 is useful to support a third infant when infant feeding and support pillow 100 is used on the floor or other surface. Alternate third opening 41 accepts an optional removable insert 44 to fill alternate third opening 41 or for other purposes, such as to provide back support to the user. In one embodiment, infant feeding and support pillow 100 has a strap 50' with fastening device 52' connected between lobes 25*a*, 25*b*. Strap 50' is preferably adjustable and connects between lobes 25*a*, 25*b* to provide structural support to infant feeding and support pillow 100. Strap 50' may also be useful to secure removable insert 44 within third opening 41. When used for feeding, the pillow's "fit" around the user's waist may be adjusted by tightening or loosening strap 50'. Instead of strap 50', lobes 25*a*, 25*b* may be connected together with a snap, button, hook-and-loop fastener, hook, or other device.

Removable insert 44 in some embodiments is a cylindrical pillow similar in construction to the rest of infant support and feeding pillow 100 with a cover and filling material. In other embodiments, removable insert 44 is bulk material, such as a block of foam. Removable insert 44 preferably has a diameter that coincides to the size and shape of third opening 41 and a height about the same as thickness 90 of feeding and support pillow 100. Accordingly, a user may place removable insert 44 into third opening 41. The user may secure removable insert 44 in position by tightening strap 50' to restrict third opening 41 against removable insert 44. Removable insert 44 (or its filling material) in other embodiments is more or less dense than feeding and support pillow 100 to provide customizable variations in back support to the user. Also, removable insert 44 in some embodiments extends above top surface 20*a* of feeding and support pillow 100 and may optionally feature flanges, wings, or other shape modifications to support the user's back.

Figure 7:
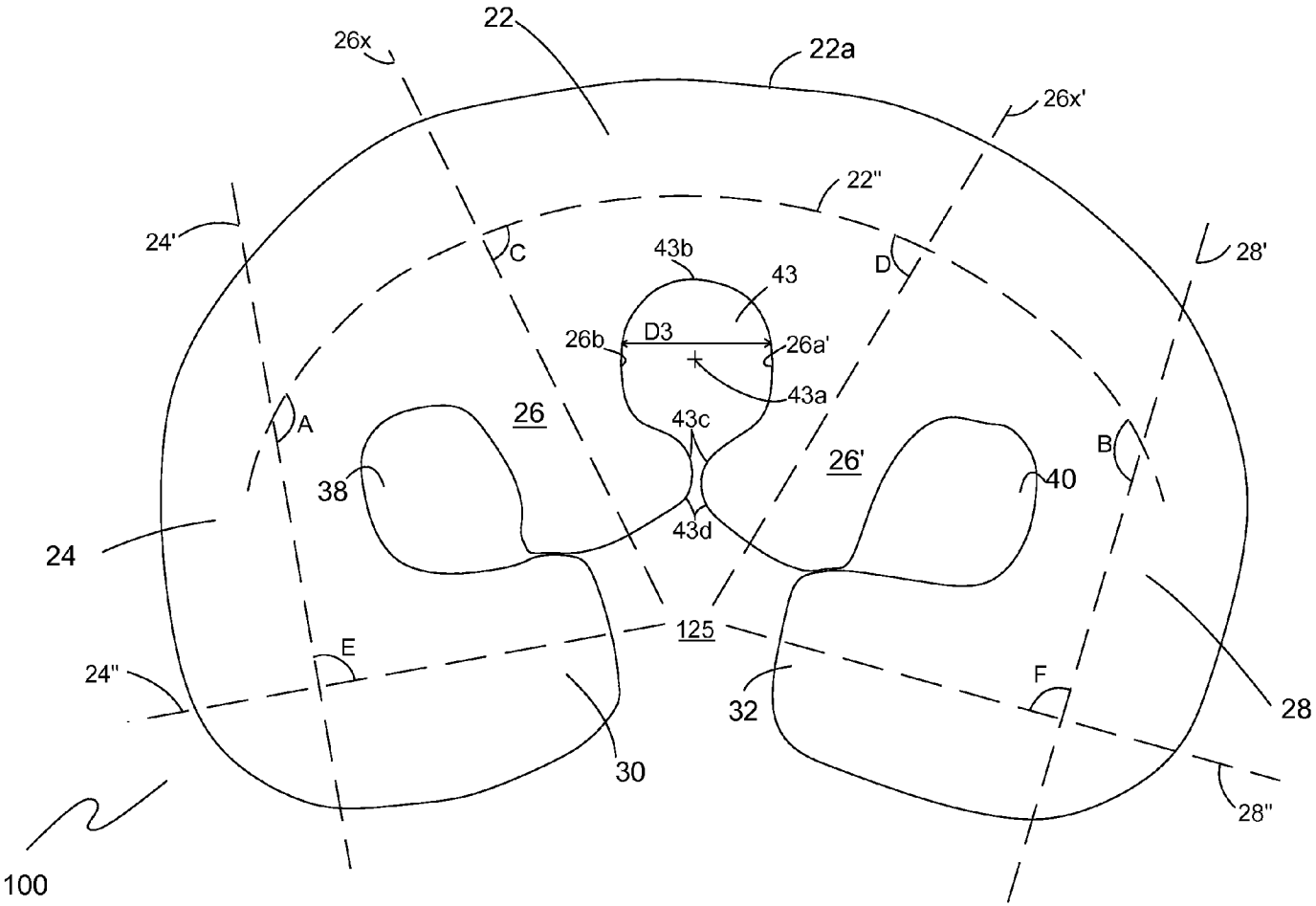
FIG. 7 illustrates a top view of a further embodiment of the infant feeding and support pillow showing a third opening in an arcuate arrangement.

FIG. 7 illustrates a further embodiment of infant feeding and support pillow 100 shaped substantially like a kidney and having first opening 38, second opening 40, and a third opening 43. In this embodiment, back edge 22*a* is curved and longitudinal base portion 22 follows an arcuate base axis 22". First end arm 24 extends from longitudinal base portion 22 where longitudinal first-end-arm axis 24' intersects arcuate base axis 22" at angle A that is obtuse. Distal end 30 of first end arm 24 preferably extends along first distal end axis 24" from first end arm 24 at angle E to longitudinal first-end-arm axis 24', which is approximately a right angle.

Second end arm 28 extends from longitudinal base portion 22 where longitudinal second-end-arm axis 28' intersects arcuate base axis 22" at angle B that is obtuse. Distal end 32 of second end arm 28 extends along second distal end axis 28"

from second end arm 28 at angle F to longitudinal second-end-arm axis 28', which is approximately a right angle.

First middle arm 26 extends along first middle arm axis 26*x* that intersects arcuate base axis 22" at angle C that is approximately a right angle. Second middle arm 26' extends along second middle arm axis 26*x'* that intersects arcuate base axis 22" at angle D that is approximately a right angle. Infant feeding and support pillow 100 is preferably configured such that each of first distal end axis 24", first middle arm axis 26*x*, second middle arm axis 26*x'*, and second distal end axis 28" extend towards a central point or central region 125. Central region 125 is preferably located between distal end 30 of first end arm 24 and distal end 32 of second end arm 28. In some embodiments, central region 125 has a substantially pentagonal shape defined by the ends of first end arm 24, first middle arm 26, second middle arm 26', and second end arm 28. Central region 125 is not limited to a pentagonal shape.

Third opening 43 has a center 43*a* and is bounded by first middle inside edge 26*b* of first middle arm 26 and first additional middle inside edge 26*a'* of second middle arm 26'. Similar to embodiments described above, second middle inside edge 26*b* of first middle arm 26 is separated from first additional middle inside edge 26*a'* of second middle arm 26' by distance D3 across third opening 43. Distance D3 in some embodiments is a constant value; in other embodiments, D3 increases and/or decreases from a third opening base margin 43*b* nearest longitudinal base portion 22, through an optional neck portion 43*c* of third opening 43, and to a third opening front edge margin 43*d*.

In use, infant feeding and support pillow 100 allows multiple infants to be placed in a variety of comfortable positions in a safe manner. For example, one infant may be placed in first opening 38 of infant feeding and support pillow 100 while a second infant is placed in second opening 40. In alternate embodiments of feeding and support pillow 100, a third infant is placed in third opening 42 (or 41). While occupying openings 38, 40, 42 (or 41) each infant is protected by the cushioning of infant support pillow 100 that surrounds each of the infants.

E-shaped infant feeding and support pillow 100 show in FIGS. 1-4 has the additional feature of allowing infant twins, when disposed within openings 38, 40, to reach across middle arm 26 to interact with each other. Infant twins have been accustomed to physically interacting with each other since sharing their mother's womb. Thus, a twin may become stressfully agitated if he/she is in sight of his/her sibling but cannot reach out to touch him/her. If one were to utilize two traditional infant feeding and support pillows, which each only have one opening, instead of infant feeding and support pillow 100, a set of twins would be unable to interact with each other even if the traditional pillows are placed directly next to each other because the twins would have to reach over two separate arm sections to reach each other. Infant feeding and support pillow 100 solves this problem by providing only a single segment (e.g., middle arm 26) between the infant twins.

In other embodiments of infant feeding and support pillow 100 shown in FIGS. 5, 6, and 7, three infants may occupy openings 38, 40, and 42/41/43. Similar to the benefits discussed above, infants in these embodiments are disposed in a linear, triangular, or arcuate arrangement, respectively. In the linear embodiment shown in FIG. 5, adjacent infants are separated by middle arms 26, 26', respectively. In the triangular embodiment shown in FIG. 6, all three infants are disposed substantially equidistant from each other. Openings 41 and 40 are separated by a portion 25*c* of middle region 25 between openings 40 and 41; infants disposed in openings 38 and 40 are separated by middle arm 26; and infants disposed in openings 38 and 41 are separated by a portion 25*d* of middle region 25 between openings 38 and 41. In the arcuate embodiment shown in FIG. 7, infants are disposed in a somewhat offset arrangement where each infant can see the other two infants with ease.

Figure 8:
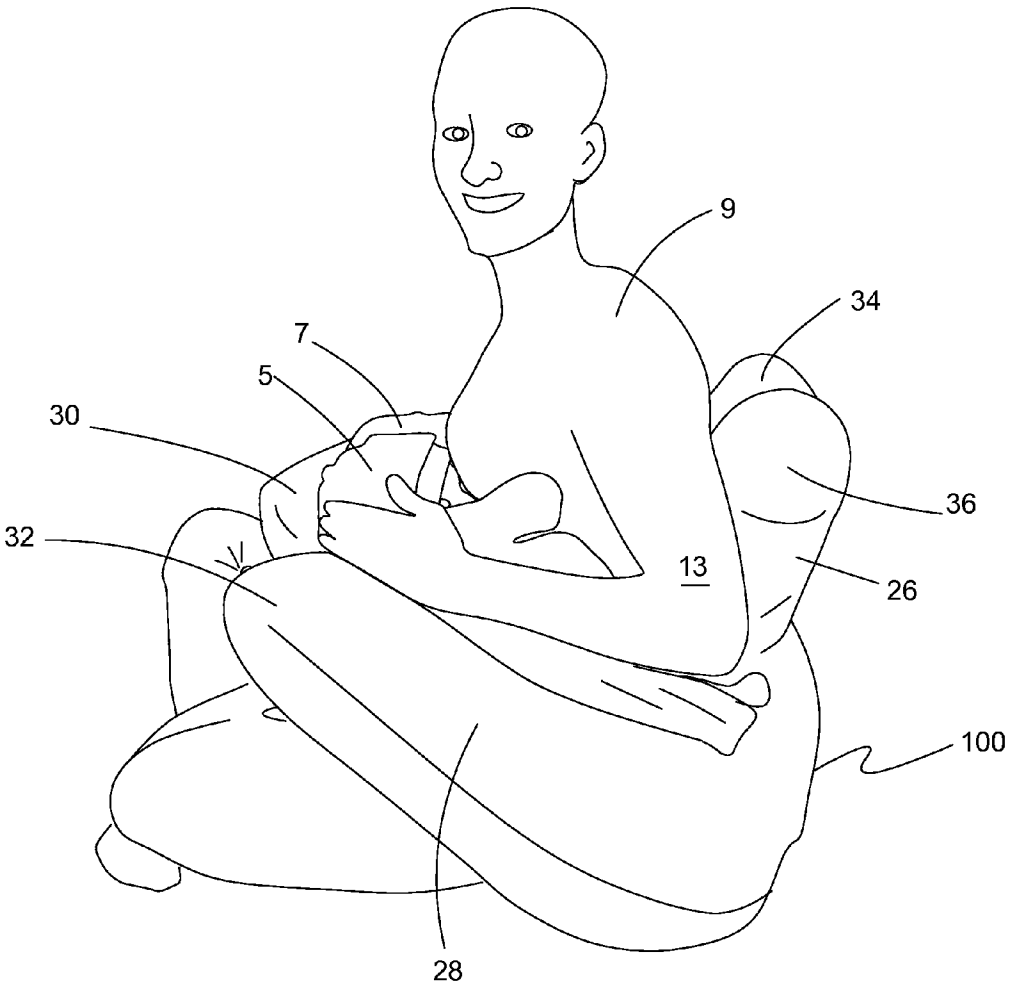
FIG. 8 illustrates a side view of an infant feeding and support pillow showing a middle arm supporting a user's back.
Figure 9:
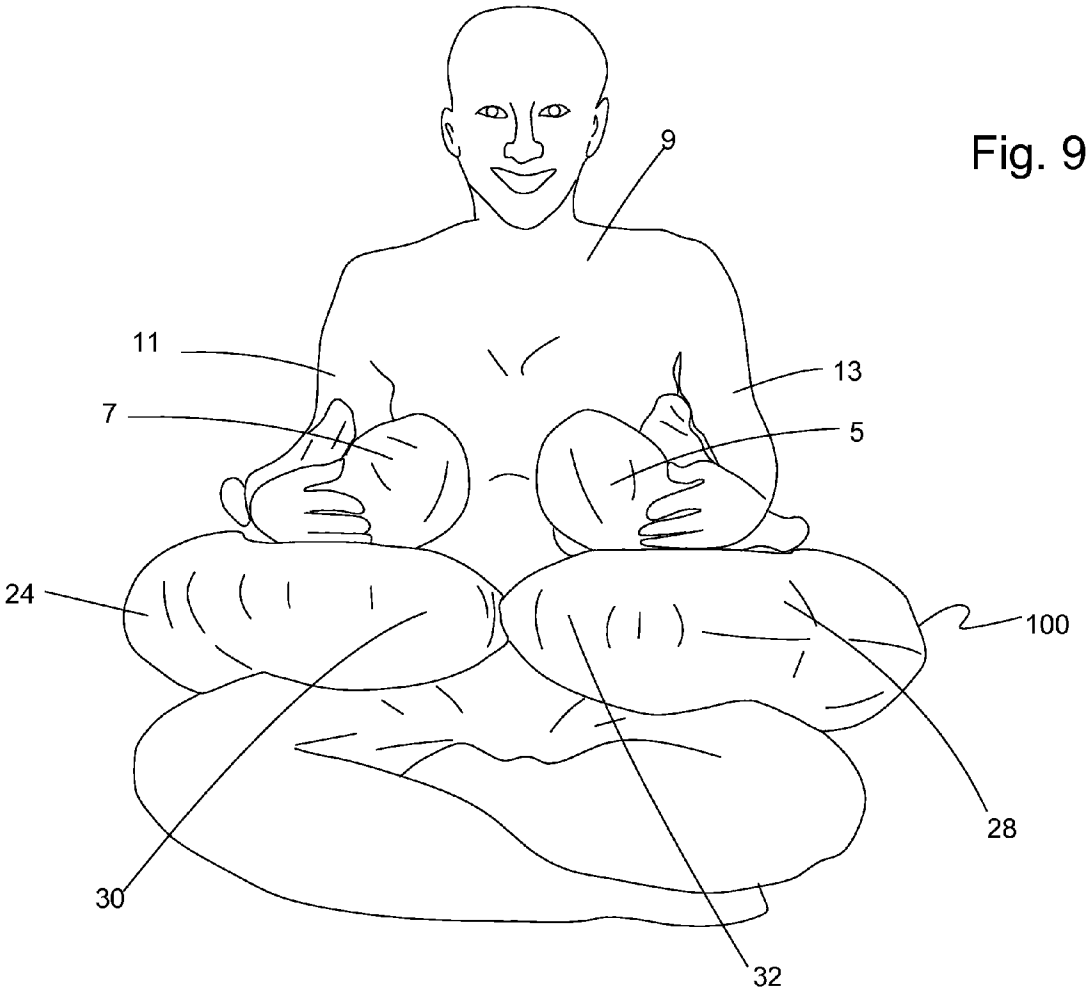
FIG. 9 illustrates a front view of an infant feeding and support pillow showing a user with two infants in a breast-feeding position.

Infant feeding and support pillow 100 also provides a mother with the ability to simultaneously breast feed two infant twins in a comfortable manner. FIGS. 7 and 8 illustrate side and front views, respectively, of a mother 9 breast feeding a set of twins 5, 7 by using infant feeding and support pillow 100. While breast feeding, middle arm 26 is rotated upward approximately 90 degrees out of the plane of the rest of infant feeding and support pillow 100. Ends 34, 36 of middle arm 26 extend towards the mother's shoulder blades. The mother 9 sits in the place previously occupied by middle arm 26 with middle arm resting against the mother's back. The torsion of middle arm 26 naturally biases end 30 of first end arm 24 and end 32 of the second end arm 28 toward each other. This motion serves to wrap first end arm 24 and second end arm 28 around the waist of the mother 9.

Infant feeding and support pillow 100 allows the mother 9 to cradle an infant twin 5, 7 on each of her arms with each hand holding an infant's head to one of her breasts. The orientation of infant feeding and support pillow 100 allows the mother 9 to support her right arm 11 while cradling an infant 7 on the first end arm 24 of pillow 100. It also allows the mother to support her left arm 13 while cradling second infant 5 on the second end arm 28 of pillow 20, and support her back against the rotated middle arm 26.

Infant feeding and support pillow 100 provides several advantages over traditional infant feeding and support pillows that only have one opening. One advantage of infant feeding and support pillow 100 is that the middle arm 26 provides back support to a user 9. Back support may be customized by using optional insert 44 in third opening 42. Breastfeeding can strain a mother's back by holding an infant for long periods of time. Back strain is magnified when a mother attempts to hold two infants at the same time. Traditional infant feeding and support pillows do not provide any back support at all. However, infant feeding and support pillow 100 provides cushioning for a mother's back to allow her to comfortably sit with her back against a wall or other surface while breastfeeding. Additionally, the T-shape of middle arm 26 (or 26') allows each of the mother's shoulder blades to be supported by each of the distal ends 34, 36 (or 34', 36').

Another advantage of infant feeding and support pillow 100 is that it provides openings of a smaller size for supporting infant twins individually, and an opening of a larger size for supporting a mother while breastfeeding. Use of strap 50 and/or 50' enables the user to adjust the size of openings 38, 40, 42. Traditional infant feeding and support pillows utilize a single opening of a fixed size to support an infant and to wrap around a mother's waist while feeding. It is impractical to use openings of the same size to wrap around a smaller infant and a larger mother. Infant feeding and support pillow 100 solves this problem by utilizing a smaller opening (e.g., opening 38, 40) to accommodate an infant and a larger opening (e.g., the opening formed from the combination of opening 38, opening 40, and the space left by the displaced middle arm segment 26) to accommodate a mother while breastfeeding.

In one method of making infant feeding and support pillow 100, a matching pair of top and bottom fabric pieces are cut to the shape of the top-view outline of the pillow and placed with the finish surface of each piece facing each other. The fabric pieces are sewn together along substantially the entire perimeter, leaving an unsewn portion of about 15 cm. The sewn-together fabric pieces are pillow cover 20. Pillow cover 20 is then turned inside-out by pulling the fabric through the unsewn portion so that the finish surface of the fabric pieces are now on the outside of pillow cover 20. Pillow cover 20 is then filled through the unsewn portion with filling material such as 100% premium polyester fiberfill. The unsewn portion is then sewn closed.

Infant feeding and support pillow preferably has overall dimensions of about 115 cm wide and 67 cm from front to back. Openings optimally have a spacing or diameter of about 16 cm and a preferred range of between 8 cm and 24 cm. First end arm 24 and second end arm 28 each are preferably about 25 cm in width from the outside edge to the edge bounding the opening. The distance across middle arm 26 between the edge of first opening 38 to the edge of second opening 40 is preferably about 30 cm. The distance across first distal end 34 to second distal end 36 of middle arm 26 is preferably about 40 cm. Longitudinal base portion is preferably about 25 cm from back edge 22*a* to first opening base margin 38*b* or second opening base margin 40*b*.

Optionally, a zipper, hook-and-loop fastener strip, or other closure device is sewn along the length of the unsewn portion and used to open and close the unsewn portion in the pillow cover 20. When foam is used to fill pillow cover 20, a larger unsewn portion along most or all of the back edge 22*a* of the pillow makes it easier to insert the foam into pillow cover 20. Optionally, to provide a pillow with increased thickness, a strip of fabric may be sewn between top and bottom fabric pieces, where the strip of fabric forms the sidewall of pillow cover 20 along the outline of the pillow.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. An infant feeding and support pillow comprising:

a pillow cover comprising:

a longitudinal base portion extending along a longitudinal base axis and having a first end region, a middle region, and a second end region;

a first end arm having a distal end and extending transversely from the first end region of the longitudinal base portion along a longitudinal first-end-arm axis;

at least one middle arm having a distal end extending transversely from the middle region of the longitudinal base portion, wherein each at least one middle arm extends along a longitudinal middle-arm axis substantially perpendicular to the longitudinal base axis; and a second end arm having a distal end and extending transversely along a longitudinal second-end-arm axis from the second end region of the longitudinal base portion, wherein the longitudinal second-end-arm axis extends in substantially the same direction as the longitudinal first-end-arm axis; and filling material disposed within the pillow cover;

wherein the first end arm, the longitudinal base portion, and the at least one middle arm define a first opening configured to hold a first infant;

wherein the second end arm, the longitudinal base portion, and the at least one middle arm define a second opening configured to hold a second infant; and wherein the longitudinal middle-arm axis of the at least one middle arm is substantially perpendicular to the longitudinal base axis when the at least one middle arm is rotated upward out of a plane defined by the first end arm, the second end arm, and the longitudinal base portion.

2. The infant feeding and support pillow of claim 1, wherein the distal end of the first end arm curves towards the distal end of the at least one middle arm and the distal end of the second end arm curves toward the distal end of the at least one middle arm.

3. The infant feeding and support pillow of claim 1, wherein the distal end of the at least one middle arm has two opposing protruding portions substantially forming a T-shape.

4. The infant feeding and support pillow of claim 1, wherein the filling material is selected from the group consisting of open-cell foam, closed-cell foam, memory foam, latex rubber foam, polyester fiberfill, polystyrene beads, cotton, wool, and feathers.

5. The infant feeding and support pillow of claim 1, further comprising an adjustable strap connected between the distal end of the first end arm and the distal end of the second end arm.

6. The infant feeding and support pillow of claim 5, the strap further comprising a fastening device.

7. The infant feeding and support pillow of claim 6, wherein the fastening device is selected from the group consisting of a spring buckle, a clip, at least one D-ring, a snap, a button, a hook-and-loop fastener, a hook, and combinations thereof.

8. The infant feeding and support pillow of claim 1, wherein the pillow cover is removable.

9. The infant feeding and support pillow of claim 1, wherein the pillow cover is reversible.

10. The infant feeding and support pillow of claim 1, wherein the pillow cover is substantially E-shaped.

11. The infant feeding and support pillow of claim 1, wherein at least one of the first opening and the second opening is substantially circular.

12. The infant feeding and support pillow of claim 1, further comprising a first lobe and a second lobe each extending along a back edge of the longitudinal base portion, the back edge positioned opposite the longitudinal base portion of the at least one middle arm, wherein the middle region of the longitudinal base portion, the first lobe, and the second lobe define a third opening opposite the at least one middle arm, and wherein a center of the first opening, a center of the second opening, and a center of the third opening define a triangle.

13. The infant feeding and support pillow of claim 12, further comprising a removable insert configured and arranged to occupy the third opening.

14. The infant feeding and support pillow of claim 13, wherein the removable insert extends above a top surface of the longitudinal base portion.

15. The infant feeding and support pillow of claim 12, further comprising a strap connected between the first lobe and the second lobe.

16. The infant feeding and support pillow of claim 1, wherein the pillow cover is substantially kidney-shaped.

17. The infant feeding and support pillow of claim 16, wherein at least one of the first opening, the second opening, and the third opening is substantially circular.

18. The infant feeding and support pillow of claim 1, wherein one of the at least one middle arm, a second one of the at least one middle arm, and the longitudinal base portion define a third opening positioned between the first opening and the second opening, the third opening configured to hold a third infant.

19. The infant feeding and support pillow of claim 18, wherein at least one of the first opening, the second opening, and the third opening is substantially circular.

20. The infant feeding and support pillow of claim 1, wherein the first opening is substantially enclosed by the first end arm, the longitudinal base portion, and the at least one middle arm, and wherein the second opening is substantially enclosed by the second end arm, the longitudinal base portion and the at least one middle arm.

* * * * *